US005386678A

United States Patent [19]

Kujubu

[11] Patent Number: 5,386,678

[45] Date of Patent: Feb. 7, 1995

[54] METHOD AND APPARATUS FOR VACUUM PACKAGING

[75] Inventor: Eitaro Kujubu, Mihara, Japan

[73] Assignee: Furukawa Mfg. Co., Ltd., Tokyo, Japan

[21] Appl. No.: 89,855

[22] Filed: Jul. 12, 1993

[51] Int. Cl.[6] ..... B65B 31/02

[52] U.S. Cl. ..... 53/434; 53/95; 53/512

[58] Field of Search ..... 53/89, 95, 405, 434, 53/512

[56] References Cited

U.S. PATENT DOCUMENTS

| | | | |
|---|---|---|---|
| 3,910,009 | 10/1975 | Canfield | 53/95 X |
| 3,958,391 | 5/1975 | Kujubu | 53/95 X |
| 4,538,399 | 9/1985 | Muller | 53/512 |
| 4,580,393 | 4/1986 | Furukawa | 53/512 |
| 4,586,320 | 5/1986 | Takai et al. | 53/512 |
| 4,723,392 | 2/1988 | Takeda | 53/434 |
| 4,754,596 | 7/1988 | Yasumune et al. | 53/434 |
| 4,843,796 | 7/1989 | Furukawa | 53/434 |
| 5,009,060 | 4/1991 | Furukawa | 53/512 |
| 5,062,252 | 11/1991 | Kupcikevicius | 53/434 |
| 5,119,615 | 7/1992 | Kujubu et al. | 53/573 X |

FOREIGN PATENT DOCUMENTS

| | | | |
|---|---|---|---|
| 1-99924 | 4/1989 | Japan | 53/512 |

*Primary Examiner*—Lowell A. Larson
*Assistant Examiner*—Daniel Moon
*Attorney, Agent, or Firm*—Joseph W. Farley

[57] ABSTRACT

The track for a pressure chamber overlaps the track for a clamper in movement while clamping a bag filled with an article, at a position beneath the latter track and with a level difference. The bag supported by the clamper is held, at its upper edge positioned right below the clamper, between the upper side of a chamber body of the pressure chamber and the upper side of a cover and in a sealed condition. The air in the bag is expelled through a notched line formed in an upper portion of the bag as the pressure within the pressure chamber is reduced, and then the bag is sealed at a position below the notched line.

2 Claims, 5 Drawing Sheets

METHOD AND APPARATUS FOR VACUUM PACKAGING

FIELD OF THE INVENTION

The present invention relates a vacuum packaging method and apparatus wherein a packaging bag having a charging port formed along the upper edge thereof is transported along a first endless track and, while the bag is in movement on the first endless track, an article is filled into the bag, the filled bag being then transferred to a pressure chamber moving in rotation along a second endless track so that the article is vacuum packaged into the bag in the pressure chamber.

BACKGROUND OF THE INVENTION

An apparatus of a concept similar to the above mentioned concept is disclosed in U.S. Pat. No. 5,119,615. According to the arrangement described in this publication, there are provided a multiplicity of sets of clampers, each set consisting of one pair, around the circumferential edge of a circular disc, it being arranged that the disc and clampers are moved in rotation in integral relation. Through this rotational movement, the clampers move along a circular track and upper edge portions of the bags suspended from the clampers are opened wide during their movement. An article is filled into each bag through the wide open mouth thereof, and the bag having the article contained therein is moved to a final station of the circular track. At the final station, the bag is released from the clamper, and the the bag containing the article, while being supported by a rotary arm, is transferred into a pressure chamber, in which the article is vacuum packaged into the bag in an enclosed condition under reduced pressure.

In the apparatus disclosed in the foregoing United States patent, each bag released from the clamper and transferred into the pressure chamber at the final station of the circular track is similarly clamped and supported by a second clamper in the pressure chamber. The bag in which an article has been packed has already involved an inherent strain. Therefore, there is no assurance that a bag involving such strain can be accurately clamped by a second clamper in the pressure chamber. In other words, when catching distorted bags, second clampers in the pressure chamber would necessarily fail to catch bags at a rate of 2 to 3%.

Further, from the standpoint of space requirements within the pressure chamber, it is very difficult to provide large-sized clampers in the pressure chamber. While springs are utilized as a source of force for clamping bags by clampers, provision of large-size clampers require considerable space in the pressure chamber. However, provision of such excessive space in the pressure chamber would require so much long time period and excess energy for the purpose of evacuating the pressure chamber. From the standpoint of energy saving and efficiency improvement, therefore, space availability in the pressure chamber is naturally limited. Furthermore, large-weight bags are likely to slip off clampers.

DISCLOSURE OF THE INVENTION

Therefore, it is a primary object of the present invention to provide a method and apparatus for vacuum packaging which eliminates fail-to-catch possibilities with respect to bags and which prevents larger-weight bags from slipping off the pressure chamber.

In order to accomplish the above object, a vacuum packaging method in accordance with the invention comprises:

- intermittently transferring a bag clamped at both sides by and suspended from a clamper integrally with the clamper and along a first endless track,
- filling an article into the bag from an upper opening of the bag during intermittent movement of the bag along the first endless track, delivering the article-filled bag to a final position on the first endless track, then releasing the bag off the clamper,
- meanwhile, actuating a pressure chamber consisting of a front-open chamber body and a cover for opening and closing the open side of the chamber body to turn along a second endless track,
- closing the cover released from the chamber body at a final position on the first endless track,
- holding the upper edge of the bag, immediately before the bag is released from the clamper at the final position, between the upper side of the chamber body and the upper side of the cover in a sealed condition, then transferring the bag to the second endless track, and
- forming a notched line at an upper end portion of the bag in the pressure chamber while in turning movement on the second endless track, eliminating air out of the bag through the notched line as the pressure within the pressure chamber is reduced, then sealing the bag at a position beneath the notched line.

A vacuum packaging apparatus in accordance with the invention includes;

- a rotary bagging mechanism having a first rotor, and a chamber rotator having a second rotor,
- said rotary bagging mechanism comprising:
  - clamp means arranged in a circumferential region of the first rotor for being intermittently transferred along a first endless track as the first rotor rotates, the clamp means being operative to clamp and suspend a bag supplied from the outside of the rotary bagging mechanism at a first stop position,
  - means for filling an article into the bag while the clamped bag is being intermittently transferred together with the clamp means, and
  - means for releasing the bag from the clamp means at a final stop position on the first endless track, and
- said chamber rotator comprising:
  - a pressure chamber disposed in a circumferential region of the second rotor and designed to be moved along the second endless track as the second rotor rotates,
  - the pressure chamber comprising a front-open chamber body and a cover member for opening and closing the front-open portion of the chamber body,
  - said vacuum packaging apparatus being so arranged that at the final stop position of said first endless track, the first endless track and the second endless track are held in an overlapping relation, there being formed a level difference between said clamp means and an upper juncture between the chamber body of the pressure chamber and the cover member, said vacuum packaging apparatus further comprising:

means for introducing the bag clamped by the clamp means into a space between the chamber body and the cover member at said overlapping portion of the tracks, then closing the cover member, and thereby holding the upper edge of the bag released from the clamp means between the upper side of the chamber body and the upper side of the cover member in sealed condition, and means for forming notches on an upper portion of the bag within the pressure chamber in movement while keeping the bag in clamped condition, expelling air out of the bag through the notches as the pressure in the pressure chamber is reduced, and sealing the bag at a position below the notches.

According to the present invention, the rotary bagging mechanism and the chamber rotator are arranged in such a way that the track for the pressure chamber overlaps the track for the clamper in movement while clamping the bag at a position beneath the latter track with a level difference. Therefore, the bag supported by the clamper is directly held between the chamber body and the cover plate so as to be housed in the pressure chamber, whereby the bag is transferred from the rotary bagging mechanism to the chamber rotator. Further, a notched line is formed, and air in the bag is expelled through the notched line, the bag is being then sealed at a location below the notched line.

In this way, according to the invention, the bag is transferred into the pressure chamber while being held between a wide open space between the chamber body and the cover plate.

Therefore, as compared with the prior art arrangement in which a bag is received by a clamper disposed in a pressure chamber, the arrangement of the invention is much less likely to involve fail-to-catch bag possibility. Further, the arrangement of the invention is capable of positively holding larger-weight articles.

The pressure chamber does not require any space for clamper arrangement. This provides for good improvement in vacuum suction efficiency.

DESCRIPTION OF THE PREFERRED EMBODIMENT

Figure 1:
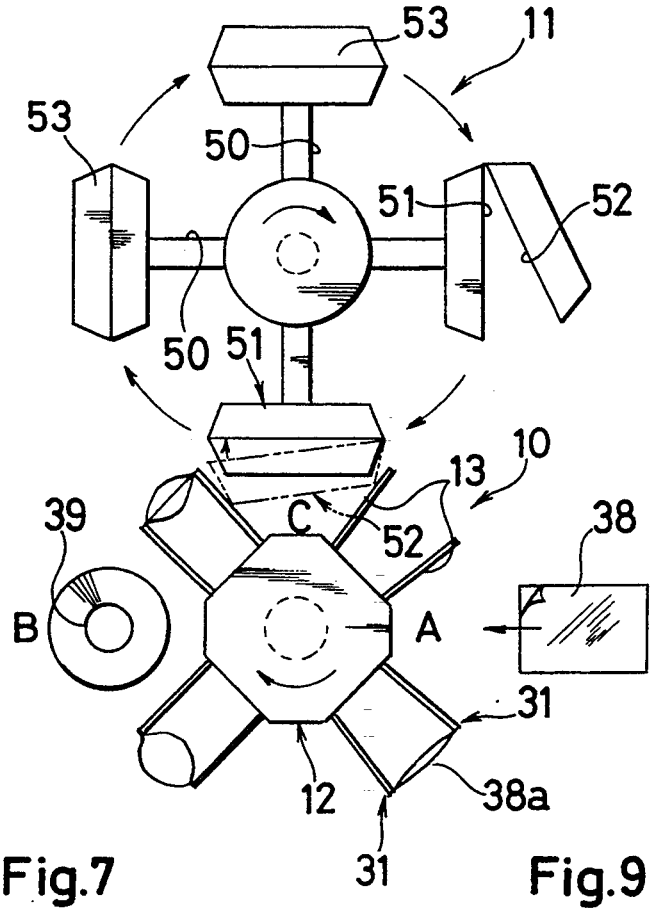
FIG. 1 is an overall plan view showing a schematic arrangement of a vacuum packaging apparatus according to the invention.
Figure 2:
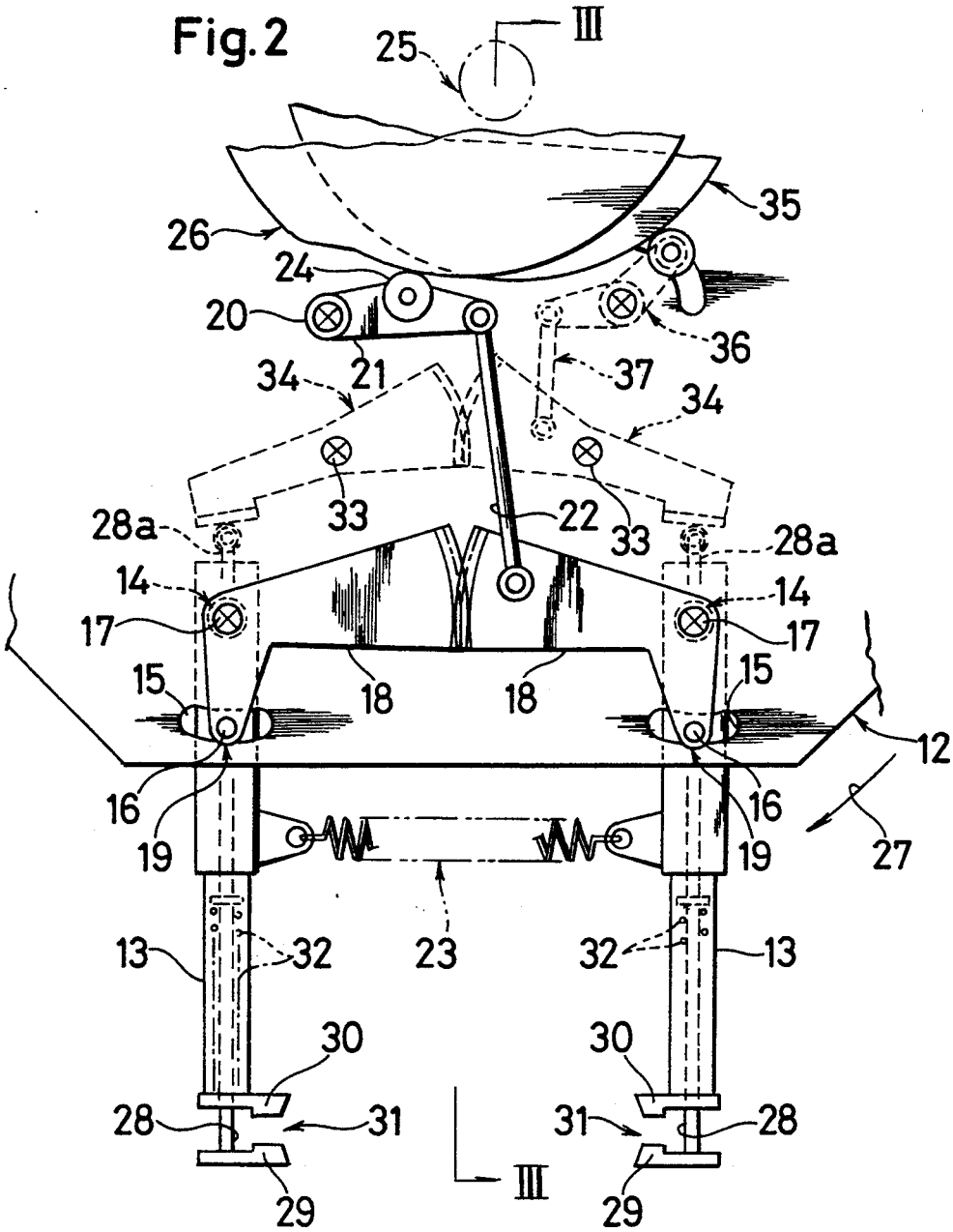
FIG. 2 is a partial plan view of a rotary bagging mechanism shown in FIG. 1.
Figure 3:
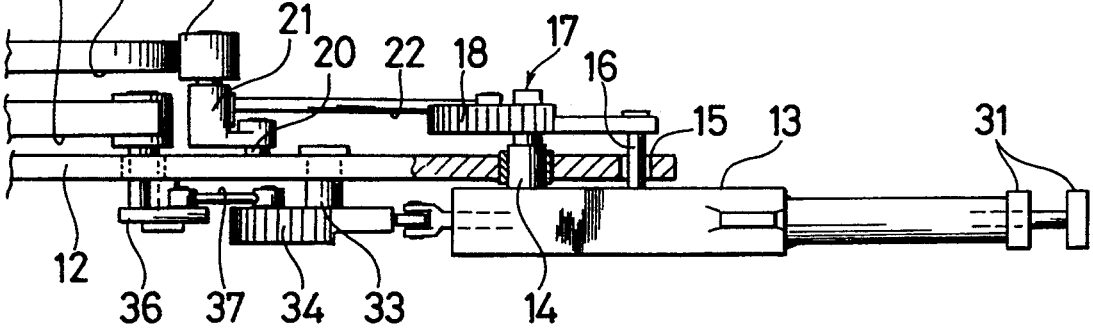
FIG. 3 is a section taken along the line III—III in FIG. 2.

In FIG. 1 which shows in plan a general arrangement of the vacuum packaging apparatus according to the invention, the packaging apparatus includes a rotary bagging mechanism 10 and a chamber rotator 11 arranged adjacent to each other. The rotary bagging mechanism 10 has a plate-like first rotor 12 with four sets of arms 13, each set of two arms, arranged about the circumferential edge of the first rotor 12 and extending radially in four directions. As shown in FIG. 2 which depicts one set of arms on an enlarged scale, the two arms 13 which constitute the one set are arranged under the rotor 12 and are each rotatably supported at one end on the rotor 12 through a pivot pin 14. As may be more readily understood with reference to FIG. 3, a pin 16 fixed on each of the two arms 13 projects upward beyond the rotor through the corresponding one of two arcuate apertures 15 formed in the rotor, and the two pins 16 are engaged respectively by ends of a pair of arcuate gears 18 which are pivotally supported respectively about two fixing pins 17 provided upright on the rotor 12 and which are in mesh engagement with each other. A bell-crank 21 is supported at one end thereof by a pin 20 fixed on the rotor 12, the other end of the bell-crank 21 being connected with one of the arcuate gears 18 by a connecting rod 22. A roller 24 provided on the bell-crank 21 at a central location is brought into abutment against the circumferential edge of an upper cam 26 disposed about a rotor axis 25, under the tensile force of a spring 23 provided between the two arms 13. Therefore, as the rotor 12 rotates in the clockwise direction 27, the roller 24 moves along the circumferential edge of the upper cam 26 and, when the bell-crank 21 is caused to pivot about the pin 20 by a circumferential irregularity of the upper cam 26, respective ends of the two arms 13 are moved away from or toward each other.

A clamper 31 consists of a pair of movable pawls 29 each provided at the distal end of a rod 28 extending through each of the two arms 13, and a pair of stationary pawls 30 each provided at the distal end of each arm 13. The movable pawls 29 are normally biased against the respective stationary pawls 30 by the tensional force of coil springs 32 arranged in the interior of the corresponding arm 13. The ends **28*a* of the two rods 28 which project from the proximal ends of the respective arms 13 are connected respectively to a pair of second arcuate gears 34 which are each supported by a pivot pin 33 on the underside of the rotor 12** for mesh engagement with each other.

A second bell-crank 36 which is in contact with a lower cam 35 is connected with a second arcuate gear 34 through a rod member 37. The rotor 12 is connected with a drive source so as for it to turn intermittently for an angle of 90 degrees each so that when the rotor 12 turns an angular distance of 90 degrees only, the lower cam 35 turns for an angle of 90 degrees only integrally with the rotor 12. While the rotor is at a stop, the lower cam 35 turns reverse for 90 degrees to return to its original position. Therefore, even when the rotor 12 is at a stop position, the clamper 31 in its open position is closed by such reverse motion of the lower cam 35, while another clamper at another position which is in its closed position is opened.

More specifically, in FIG. 1, a bag 38 supplied at a first point (A) is supported by a clamper 31 held in its stop position, and while being suspended from the clamper, the bag **38*a* is moved along a first circular track as the first rotor 12 rotates. At a second point (B), the bag 38** is filled with an article via a flared type hopper 39. Then, at a final point (C), the bag is released from the clamper.

Figure 4:
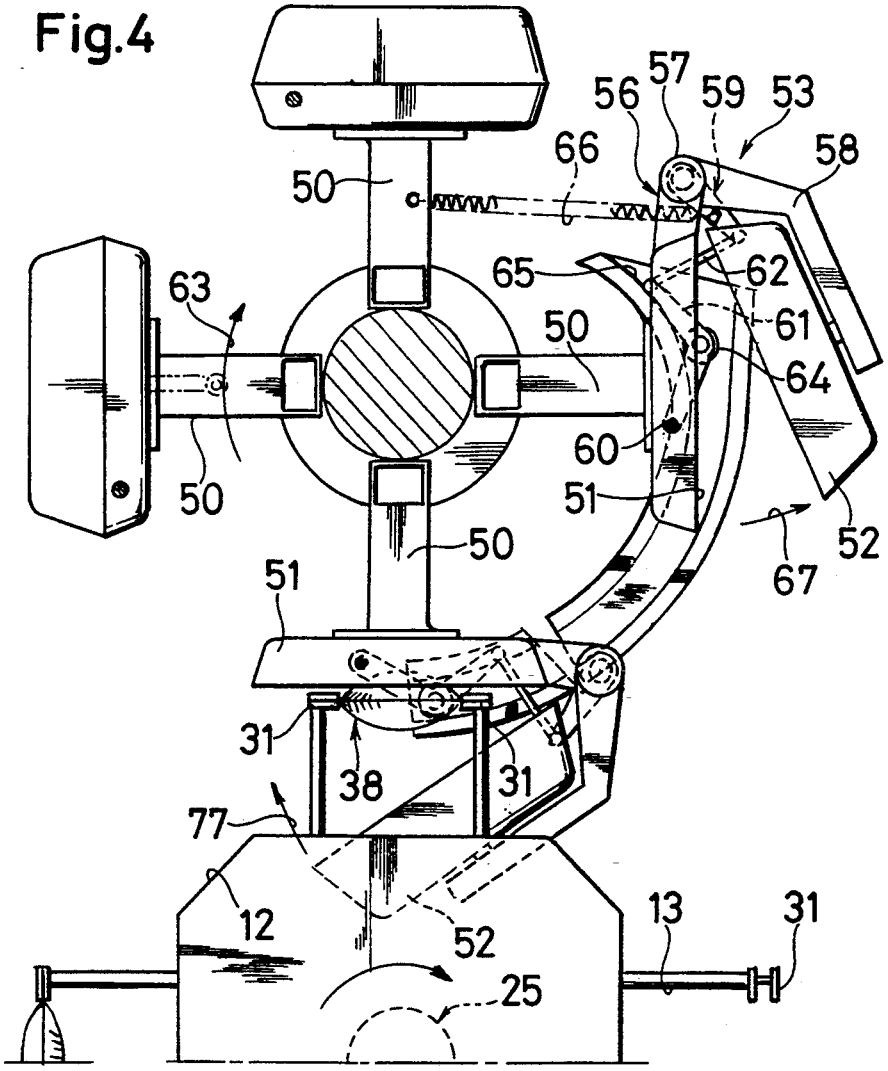
FIG. 4 is a sectional view in plan showing a chamber rotator in FIG. 1.
Figure 5:
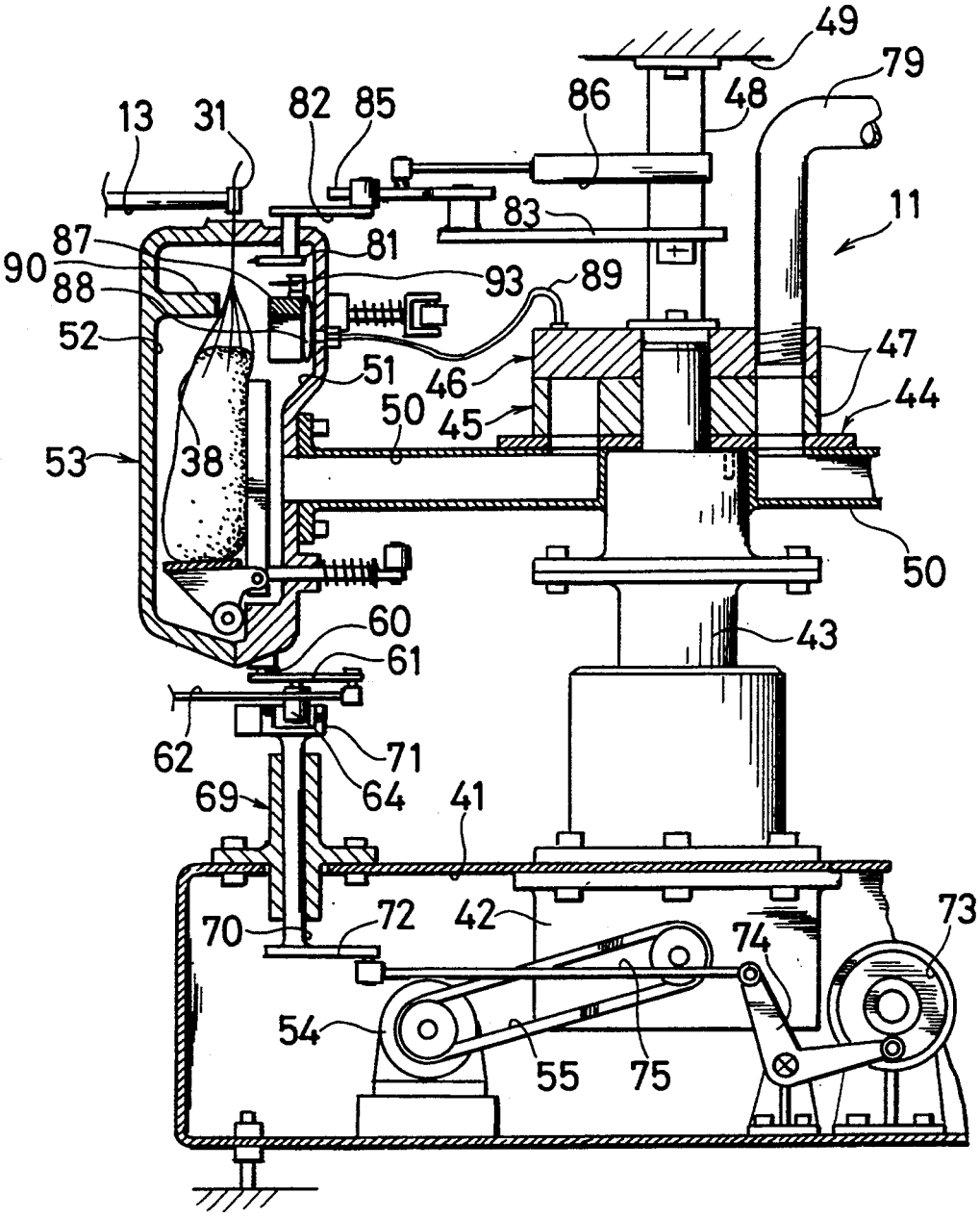
FIG. 5 is a sectional view in side elevation of the chamber rotator shown in FIG. 4.

Details of the chamber rotator 11 shown in FIG. 1 are depicted in FIGS. 4 and 5. In FIG. 5, on the top end of a main shaft 43 extending vertically from an index unit 42 provided in the interior of a machine frame 41 there is mounted a disc-shaped second rotor 44. A rotary valve 47 consisting of a movable platen 45 and a stationary platen 46, both of a circular shape, is mounted on the rotor 44, the movable platen 45 being fixed to the rotor 44, the stationary platen 46 being coupled to a non-moving portion 49 via a member 48. Front-open chamber bodies 51 are fixed individually to forward to ends of four rectangular pipes 50 projecting horizontally radially from the underside of the rotor 44, with cover plates 52 provided at respective open sides of the chamber bodies 51. Each chamber body 51 and each cover plate 52 in combination makes a pressure chamber 53. As a driving force of a motor 54 is input to the index unit 42 via a belt 55, the main shaft 43 goes into intermittent rotation for an angle of 90 degrees each to bring each pressure chamber 53 into intermittent movement along a second circular track.

As FIG. 4 shows, a shaft rod 57 having a longitudinal axis is rotatably supported in a bracket 56 fixed to one side of each chamber body 51, arms 58 projecting laterally from the periphery of the shaft rod 57, by which arms a cover plate 52 is supported. A lever 59 fixed to the lower end of the shaft rod 57 is connected via a rod member 62 with a bell-crank 61 which is supported on the under side of the chamber body 51 through a pin 60. As the pressure chamber 53 turns in the clockwise direction 63, a roller 64 centrally supported on the bell-crank 61 advances into a groove-shaped rail 65, whereupon the bell-crank 61 turns about the pin 60. As a consequence, the cover plate 52 which is normally in a closed condition under the tensile force of a spring 66 is moved away from the chamber body 51 as shown by an arrow 67, whereupon the chamber 53 comes to a stop. As the pressure chamber 53 from which the cover plate 52 has been released resumes movement, the roller 64 moves along the groove-shaped rail 65 and, therefore, the pressure chamber 53, with the cover plate 52 held in its opened position, moves to a next stop position, that is, a point of overlapping with the track of rotational movement of the clamper 31. As FIG. 5 shows, the chamber rotator 11 is disposed relative to the bagging mechanism 10 so that the track of pressure chamber 53 rotation overlaps the track of clamper 31 rotation, with the former track positioned under the latter track. Accordingly, a bag 38 suspended from the clamper 31 can be readily received into a wide-open space between the chamber body 51 and the cover plate 52.

Figure 6:
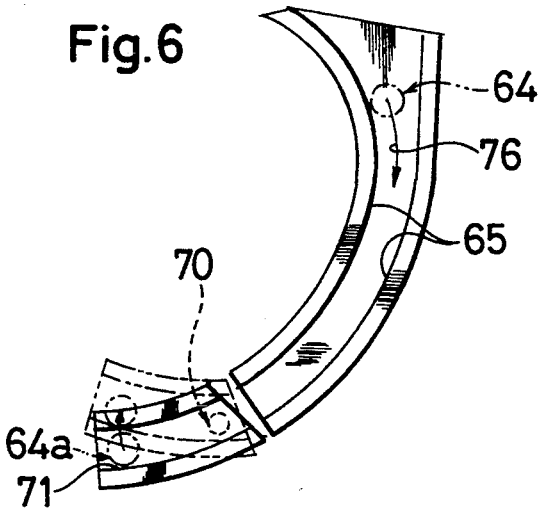
FIG. 6 is a fragmentary plan view of a rail shown in FIG. 5.

A groove-shaped movable rail 71 placed on the top end of a shaft 70 supported in a bearing 69 of the machine frame 41 is laid in continuation to the terminal of the groove-shaped rail 65, as shown in FIG. 6. A lever 72 fixed to the lower end of the shaft 70 is connected through a rod 75 with a bell-crank 74 engaging a groove cam 73, as shown in FIG. 5. While the main shaft 43 turns a quarter turn, the groove-shaped cam 73 turns one turn. Therefore, each time the pressure chamber 53 stops at a location above the movable rail 71, the lever 72 causes the shaft 70 to turn slightly. That is, when the roller 64 is advanced to a phantom position 64*a* as shown by the arrow 76 in FIG. 6 before it stops, the movable rail 71 is pivoted to change the position of the roller 64, so that the cover plate 52 in its opened position as in FIG. 4 is closed as indicated by the arrow 77. Consequently, as FIG. 5 shows, an upper portion of the bag 38 is held between the upper side of the chamber body 51 and the upper side of the cover plate 52, the article in the bag 38 being thus enclosed in the pressure chamber 53. Immediately thereafter, the clamper 31 releases the bag 38.

Figure 7:
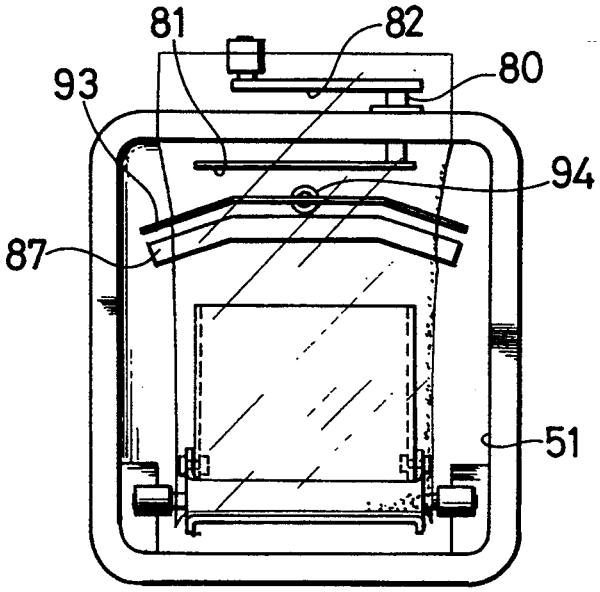
FIG. 7 is a front view showing the interior of a chamber.
Figure 9:
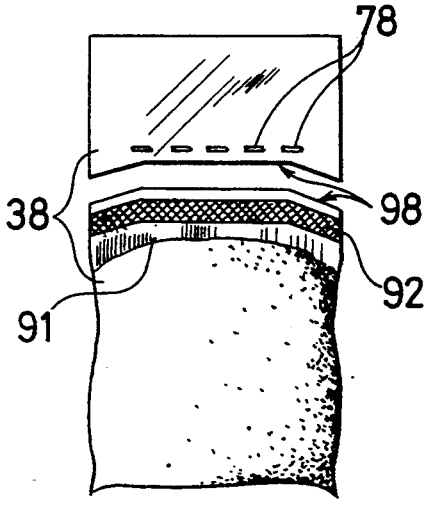
FIG. 9 is a front view of a vacuum packaging bag.
Figure 8:
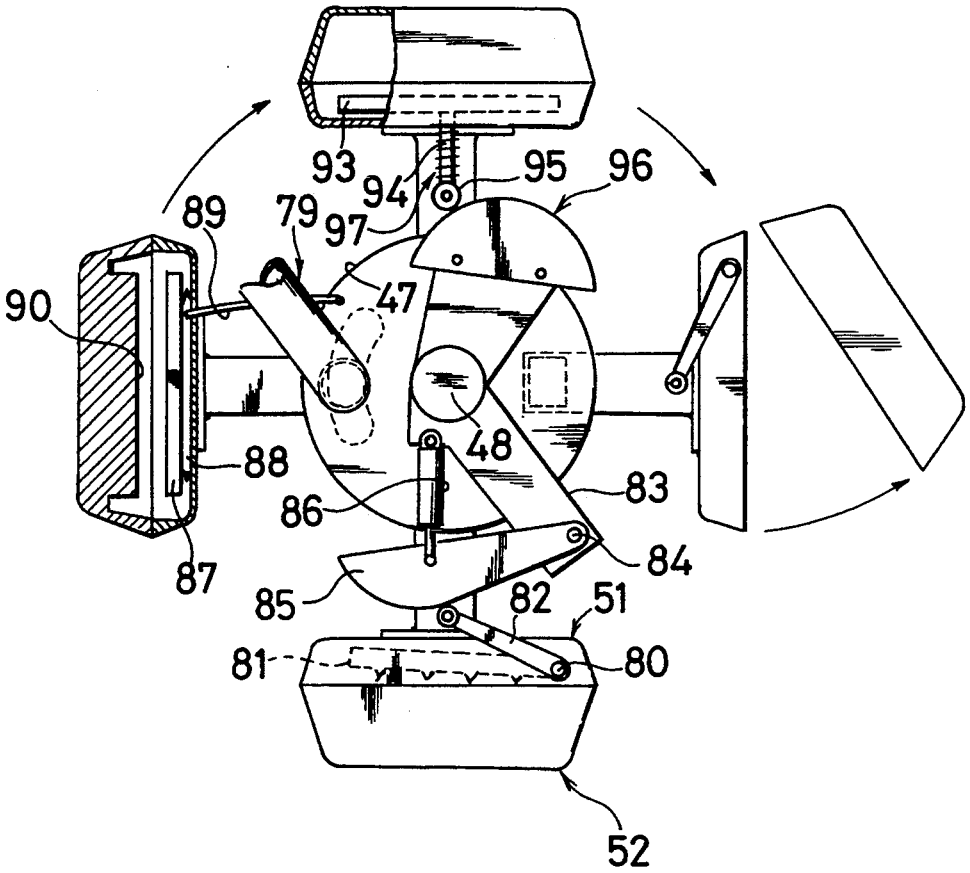
FIG. 8 is a plan view of the chamber rotator.

As FIG. 7 shows, a rotary blade 81 is provided at the lower end of a shaft 80 projecting rotatably through the ceiling of the chamber body 51, and a lever 82 is connected to the upper end of the shaft 80. A cam 85 is supported via a pin 84 on a bracket 83 connected to a stationary member 48 as shown in FIG. 8, so that when the cover plate 52 is closed toward the chamber body 51, the cam 85 in turn rotates under the pressing force of a cylinder 86 to act on the lever 82 so that the pin 80 is actuated to rotate the blade 81. Consequently, as FIG. 9 shows, an upper portion of the bag 38 is pierced at a plurality of spots so that air vents are formed therein. Subsequently, as FIG. 5 shows, the rotary valve 47 operates to communicate the pipe 50 with a vacuum line hose 79, so that evacuation of the pressure chamber 53 is commenced, whereupon air within the bag is expelled outward through the plurality of vent holes 78.

As FIG. 7 shows, a table-like seal bar 87 is disposed beneath the rotary blade 81. Compressed air is delivered from the rotary valve 47 via a tube 89 into a flexible bag 88 disposed between the seal bar 87 and the chamber body 51 as shown in FIG. 8, whereby the seal bar 87 is forced out toward a sealing table 90 formed in the inner surface of the cover plate 52. Thus, as FIG. 9 shows, the bag 38 is heat sealed along the upper surface of the artcile 91 contained therein. Shown by 92 is a heat sealed portion. As FIG. 7 shows, a cutting blade 93 disposed above the seal bar 87 is fixed to the tip of a sliding rod 94 extending rearward through a wall surface of the chamber body 51. When a roll 95 at the tip of a rod 94 comes in contact with a cam 96 to cause the cutting blade 93 to be forced out against the tensile force of a spring 97, as shown in FIG. 8, the bag 38 is severed along the upper edge of the heat sealed portion 92, as shown in FIG. 9. Shown by 98 is a cut-off portion.

What is claimed is:

1. A vacuum packaging method for a bag having an upper opening with a pair of edges comprising the steps of:

suspending the bag by clamping each of said edges from a clamper and intermittently transferring the suspended bag and clamper along a first endless track;

filling said bag with an article while the bag is being intermittently transferred along said first endless track;

intermittently transferring a pressure chamber along a second endless track positioned below said first endless track and having a point overlapping with said first endless track, said pressure chamber comprising a chamber body having a vertical open side and a cover plate for opening and closing said open side by turning about a vertical axis on one edge of said open side;

opening the cover plate from the chamber body on the second endless track at a position before said point where the first endless track and the second endless track overlap each other;

closing the cover plate after receiving the bag immediately before release thereof from the clamper into the chamber body at said point where the first endless track and the second endless track overlap each other and positioning the bag in said open side of said chamber body;

holding the bag between an upper edge of the chamber body and an upper edge of the cover plate at a position lower than the clamping position by the clamper and suspending the bag inside the pressure chamber when the cover plate is closed;

releasing the hold of the bag by the clamper and transferring the bag onto the second endless track; and forming a notch at an upper end portion of the bag in said pressure chamber under transfer on said second endless track, exhausting the air in the bag through the notch by depressurizing the inside of the pressure chamber, and sealing the bag at a position lower than said notch.

2. A vacuum packaging apparatus for a bag having an upper opening with a pair of edges, said apparatus including a rotary bagging mechanism having a first rotor and a chamber rotator having a second rotor, wherein said rotary bagging mechanism comprises:

clamping means provided in a circumferential region of said first rotor for movement intermittently along a first endless track by the rotation of said first rotor and for suspending by said edges said bag fed from outside at a first stop position of said first rotor; and means for releasing the bag, filled with an article at a following stop position, from the clamping means at a final stop position on the first endless track as the bag is being clamped by and transferred together with the clamping means; and said chamber rotator comprising:

a pressure chamber disposed in a circumferential region of the second rotor and designed to be moved along a second endless track as the second rotor rotates, the pressure chamber comprising a chamber body having a open side and a cover member for opening and closing the said open side of the chamber body, said vacuum packaging apparatus being so arranged that at a final stop position of said first endless track, the first endless track and the second endless track have an overlapping portion, there being formed a level difference between said clamping means and an upper juncture between the chamber body of the pressure chamber and the cover member, said vacuum packaging apparatus further comprising:

means for introducing the bag clamped by the clamping means into a space between the chamber body and the cover member at said overlapping portion of the tracks, then closing the cover member, said chamber body and said cover member having upper edges adapted to hold said bag in a suspended state by closing said cover member; and means for forming notches on an upper portion of the bag within the pressure chamber in movement while keeping the bag in said suspended state, expelling air out of the bag through the notches as the pressure in the pressure chamber is reduced, and sealing the bag at a position below the notches.

* * * * *